US005316091A

United States Patent [19]

Rasi et al.

[11] Patent Number: 5,316,091

[45] Date of Patent: May 31, 1994

[54] METHOD FOR REDUCING OCCURRENCES OF STUCK DRILL PIPE

[75] Inventors: Marco Rasi; Mark W. Biegler, both of Houston; Eugene A. Sikirica, Katy, all of Tex.

[73] Assignee: Exxon Production Research Company, Houston, Tex.

[21] Appl. No.: 32,799

[22] Filed: Mar. 17, 1993

[51] Int. Cl.[5] ..... E21B 7/04

[52] U.S. Cl. ..... 175/61; 175/62

[58] Field of Search ..... 175/45, 61, 62, 76, 175/53, 56

[56] References Cited

U.S. PATENT DOCUMENTS

| | | | |
|---|---|---|---|
| 4,015,673 | 4/1977 | Craig, Jr. et al. | 175/61 |
| 4,298,078 | 3/1981 | Lawrence . | |
| 4,428,441 | 1/1984 | Dellinger | 175/76 |
| 4,473,124 | 9/1984 | Savins . | |
| 4,491,181 | 1/1985 | Krol . | |
| 4,496,012 | 1/1985 | Savins . | |
| 4,643,264 | 2/1987 | Dellinger . | |
| 4,646,855 | 3/1987 | Dellinger . | |
| 4,665,996 | 5/1987 | Foroulis et al. | 175/61 |
| 4,754,819 | 7/1988 | Dellinger | 175/61 |
| 4,791,998 | 12/1988 | Hempkins et al. . | |
| 4,844,182 | 7/1989 | Tolle | 175/61 |
| 4,848,144 | 7/1989 | Ho | 175/61 |
| 4,890,682 | 1/1990 | Worrall et al. . | |

OTHER PUBLICATIONS

Brown, N. P. et al., "Cleaning Deviated Holes: New Experimental and Theoretical Studies," *Society of Petroleum Engr. SPE/IADC 18636,* presented at the 1989 SPE/AIDC Drilling Conference in New Orleans, La., Feb. 28–Mar. 3, 1989.

J. T. Ford et al., "Experimental Investigation of Drilled Cuttings Transport in Inclined Boreholes," *Society of Petroleum Engr. SPE 20421,* presented at the SPE 1990 65th Annual Technical Conference in New Orleans, La., Sep. 23–26, 1990.

Gavignet, A. A. and I. J. Sobey, "Model Aids Cuttings Transport Prediction," *Journal of Petroleum Technology,* Sep. 1989, pp. 916–921.

Gavignet, A. A. and I. J. Sobey, "A Model for the Transport of Cuttings in Highly Deviated Wells," *Society of Petroleum Engr. SPE 15417,* presented at the SPE 1986 61st Annual Technical Conference in New Orleans, La., Oct. 5–8, 1986.

Okrajni, S. S. and J. J. Azar, "Mud Cuttings Transport in Directional Well Drilling," *Society of Petroleum Engr. SPE 14178,* presented at the SPE 1985 60th Annual Technical Conference in Las Vegas, Nev., Sep. 22–25, 1985.

Oyeneyin, M. B. et al., "Efficient Hole Cleaning in Highly Deviated Wells".

Sifferman, T. R. and T. E. Becker, "Hole Cleaning in Full-Scale Inclined Wellbores," *Society of Petroleum Engr. SPE 20422,* presented at the SPE 65th Annual Technical Conference in New Orleans, La., Sep. 23–26, 1990.

Tomren, P. H. et al., "An Experimental Study of Cuttings Transport in Directional Wells," *Society of Petroleum Engr. SPE 12123,* presented at the SPE 58th Annual Technical Conference in San Francisco, Calif., Oct. 5–8, 1983.

*Primary Examiner*—Ramon S. Britts
*Assistant Examiner*—Frank S. Tsay
*Attorney, Agent, or Firm*—Pravel, Hewitt, Kimball & Krieger

[57] ABSTRACT

A method for determining a parameter by combination of engineering models and statistical analysis of drilling data in a data base to determine the frequency or probability of sticking of the drill string during drilling of wells at hole-angles from vertical to horizontal. The parameter can be used to decrease the probability of sticking of drill string during drilling a well and to minimize the cost of a well.

19 Claims, 3 Drawing Sheets

METHOD FOR REDUCING OCCURRENCES OF STUCK DRILL PIPE

BACKGROUND OF THE INVENTION

1. Field of the Invention

This invention relates to the drilling or boring of wells in the earth. More specifically, a method is provided for characterizing the effectiveness of removal of cuttings to prevent sticking of the drill string in the drilling process, based on statistical analysis of combinations of drilling variables in prior wells.

2. Description of Related Art

At times during the drilling of wells in the earth, particularly deeper wells, the drill string cannot be retrieved from the wellbore, i.e., it becomes stuck in the wellbore. The stuck-drill string problem has been widely studied, and it has generally been concluded that the more common mechanisms which can cause the drill string to become stuck include: the hole becomes unstable and collapses around the drill string; a "key seat" of the width of the drill pipe diameter forms in the wellbore wall, such that larger diameter members of the drill string cannot be pulled through; segments of the drill string are held against the wellbore wall by excess hydrostatic pressure of the drilling fluid; and, solids build-up of cuttings in the wellbore around the drill string causes sticking. Those skilled in the art of drilling can often determine which mechanism caused the drill string to become stuck, based upon a review of observations before and after the sticking occurred.

To prevent build-up of solids in the wellbore, hole-cleaning of the wellbore must be achieved by the drilling fluid. In fact, one of the primary functions of the drilling fluid is to carry the "cuttings" from the bit where they are created to the surface of the earth. In vertical or near vertical wells, the drilling fluid is normally formulated to have viscosity high enough to decrease the settling velocity of cuttings to a value much less than the upward velocity of drilling fluid in the hole, so the cuttings will be efficiently carried from the wellbore. Gel strength of the fluid is also normally formulated to prevent rapid fall of cuttings in the wellbore when fluid circulation is interrupted.

In recent years, there has been a major upswing in the drilling of wells in directions other than vertical. "High-angle" wells are drilled for hydrocarbon production from platforms constructed offshore and from pads built in the arctic. "Horizontal wells," a sub-class of high-angle wells, are drilled at angles near 90 degrees to vertical for a variety of reasons related to hydrocarbon production; they may also be drilled for environmental remediation and other purposes. Some high-angle wells may terminate at a location displaced thousands of feet horizontally from the surface location of the well. There is a very large economic incentive at times to push this horizontal displacement to the maximum distance achievable so that additional hydrocarbons can be recovered from existing surface facilities.

It has been recognized for many years that removal of the cuttings from the wellbore during drilling of high-angle wells poses a special problem. The cuttings can settle by force of gravity along the bottom of the hole, since the settling velocity is no longer much less than the vertical velocity of the drilling fluid. As the cuttings settle in the drilling fluid, a "bed" of solids is formed along the bottom of the hole. This problem is especially severe in larger size holes, where fluid velocities are lower. Experience from drilling high-angle wells shows that pipe sticking and related drilling problems are especially frequent in the larger holes (17½-inch and 12¼-inch holes) drilled at angles above about 40–50 degrees.

Removal of cuttings from vertical and intermediate angle wells can also present problems. In a vertical hole, it is believed that settling of cuttings when circulation or pumping of the drilling fluid is interrupted can cause the drill string to become stuck. At intermediate angles, cuttings may accumulate and then slide along the wellbore to enclose the drill string.

Build-up of cuttings in wellbores, or, stated another way, failure to achieve sufficient "hole-cleaning," can cause several types of problems. The most severe of these is sticking of the drill string, i.e., the drill pipe and equipment below it is stuck in the well. This condition can be very expensive to remedy. A single stuck pipe incident may cost over one million dollars. It is estimated that stuck pipe costs industry in the range from 100 to 500 million dollars per year. In attempts to avoid such problems from lack of hole-cleaning, drilling operators often include such maneuvers as "washing and reaming," wherein the drilling fluid is circulated and the drill string is rotated as the bit is introduced into the wellbore, and "backreaming," wherein the drilling fluid is circulated and the drill string is rotated as the bit is withdrawn from the wellbore. Other operations such as "wiper trips" or "pumping out of the hole" are performed to attempt to control the amount of cuttings accumulated in the wellbore. All these operations require time and can very significantly add to the cost of drilling a high-angle well.

Many studies of hole-cleaning in wells drilled at all angles from vertical to horizontal have been performed in the past. The article by S. S. Okrajni and J. J. Azar, SPE 14178, Society of Petroleum Engineers, Richardson, Tex., 1985, provides information on the subject. Several studies in university and industry laboratories in recent years have been directed to hole-cleaning in high-angle wells. Recent reports have been published, for example, by J. T. Ford et al, SPE 20421, Society of Petroleum Engineers, 1990, and by T. R. Sifferman and T. E. Becker, SPE 20422, Society of Petroleum Engineers, 1990.

It is common practice in the well drilling industry to record the values of the rheological properties and density of the drilling fluid, pumping rate of the drilling fluid, size and model of the equipment used in the drilling operation, and a variety of measurements of forces measured on the drill pipe, including, of course, the occurrence of sticking of the drill pipe in the hole. These values are normally recorded at least daily in a "morning report." In recent years large data bases containing these data for large numbers of wells have become available. Some such data bases are developed by oil companies or drilling companies and some by operators in certain geographic areas or geological provinces of the world. The existence of these data bases in machine-readable form and of computers makes possible the application of statistical techniques to large amounts of drilling data.

It has long been believed by many engineers in drilling organizations that hole-cleaning in wells will be improved, and hence the sticking of drill pipe due to lack of hole-cleaning will be lessened, by increasing the average velocity of flow of drilling fluid between the drill pipe and the wellbore wall. A data base of almost 400 wells drilled in the North Sea was used, along with well-known statistical techniques, to test this widely-accepted hypothesis. The results, shown in FIG. 1, demonstrate that the frequency of sticking of the drill string in the wells in this data base did not correlate with the annular velocity of drilling fluid in the wells. Obviously, other engineering variables must be sought which can predict sticking of drill strings.

U.S. Pat. No. 4,791,998 is directed to a method of avoiding stuck drilling equipment. The method is based on a statistical analysis of drilling variables in wells drilled in the same area, comparing wells in which sticking was experienced and not experienced, and modifying variables in a drilling well toward those conditions which the mathematical analysis indicates will not cause sticking. This patent addresses a variety of drill string sticking mechanisms. The variables which were believed to affect drill string sticking were combined in a purely statistical manner, using the implicit assumption that they combine linearly. The method disclosed in this patent does not include engineering information which accounts for the way each variable is believed to impact hole-cleaning, based on physical grounds.

There is a long-felt need for a method to determine if a well is being drilled under conditions where the drill pipe has a high risk of becoming stuck because of the accumulation of cuttings in the wellbore. The method should be applicable to wells drilled at any angle with respect to vertical. The method should couple engineering modeling and the large amount of drilling data available from prior wells. The set of engineering variables should describe the key mechanisms that govern the occurrence of stuck drill string and a method of combining engineering variables in a defined parameter should provide a statistical separation in the value of this parameter between the classes of mechanically stuck drill strings because of lack of hole-cleaning and non-stuck drill strings. A parameter which can easily be calculated should be provided and ranges in value of this parameter correlating to probabilities of sticking of the drill string should be applicable to wells drilled at any angle. The method should be applicable to planning the material and equipment which will be provided to drill a well and to adjust drilling variables while a well is being drilled. The method should be susceptible to continuous refinement as the data base expands or becomes more representative of the wells of interest, such that the risk of encountering drilling problems can be assessed with increasing confidence in a specific area.

SUMMARY OF THE INVENTION

The present invention provides a method to assess the risk of sticking the drill string in a well as a result of accumulation of cuttings in the wellbore. The engineering parameter "Effective Velocity" is developed for predicting hole-cleaning in wells of any angle.

The method utilizes a data base of physical measurements of drilling variables. These drilling variables for a number of wells (usually a large number) are measured periodically during the drilling of wells and recorded in routine fashion. Thus, when a drill pipe becomes stuck in a well, it is possible to retrieve values of the drilling variables for a selected period of time before the drill pipe becomes stuck. In the method of this invention, the variables are selected which are expected to affect most the sticking of the drill pipe because of inadequate hole-cleaning during the drilling operations. In a preferred embodiment, these variables are selected based upon statistical analysis. The variables are then combined to form an engineering expression of hole-cleaning effectiveness, which is referred to as "Effective Velocity." Combinations of variables, coefficients by which these variables are multiplied and exponents of these variables are used to calculate the expression for Effective Velocity, EV.

For each function of the drilling variable, EV, selected, its value for a number of the wells in the data base is calculated. The functional form of the function EV is selected by a statistical technique. In a preferred embodiment, the statistical technique used is to maximize the F-value. The functional form selected produces the maximum discrimination between those wells in which the pipe became stuck and did not become stuck. The functional form of EV which produces the greatest discrimination between stuck and unstuck wells is then used to calculate the value of the function EV for the data contained in the data base to produce a statistical frequency of sticking as a function of the value of the EV. These calculations for a statistically significant number of wells are used to develop a functional relationship between statistical frequency of sticking within a predetermined time and the expression of hole-cleaning effectiveness, EV. Using a large data base from wells, including a large number of wells drilled at high angles, expressions for Effective Velocity were developed for hole angles greater than 55° and hole angles less than 55°.

Such functional relationship can be applied for a well of interest which is being drilled or which is being planned to be drilled in the future. By using the drilling variables considered and calculating the hole-cleaning effectiveness, EV, for the well of interest, then referring to the function previously developed from previously drilled wells, the frequency of sticking of the drill pipe to be expected under the conditions of the drilling variables in the well of interest may be determined.

The probability values thus determined may be used in economic models to select drilling variables which will minimize the cost of drilling a well. The method of this invention may also be used to adjust the value of a drilling variable so as to alter the probability of the drill string becoming stuck as a result of inadequate hole-cleaning in a well being drilled.

DETAILED DESCRIPTION OF THE INVENTION

It is known that the mechanism of hole-cleaning in wells drilled at different angles varies. Wells drilled at angles greater than about 55° appear to be controlled by hole-cleaning mechanisms which are not nearly so important in lower angle wellbores. This difference in mechanism is primarily caused by the possibility of a bed of particles or cuttings building up at the bottom of the wellbore in high angle wells. In low angle wells, a bed of cuttings will not be so stable, if it forms. Therefore, it is advantageous to develop a parameter expressing hole-cleaning for wells less than about 55° and a separate parameter for well angles larger than about 55°.

Figure 2:
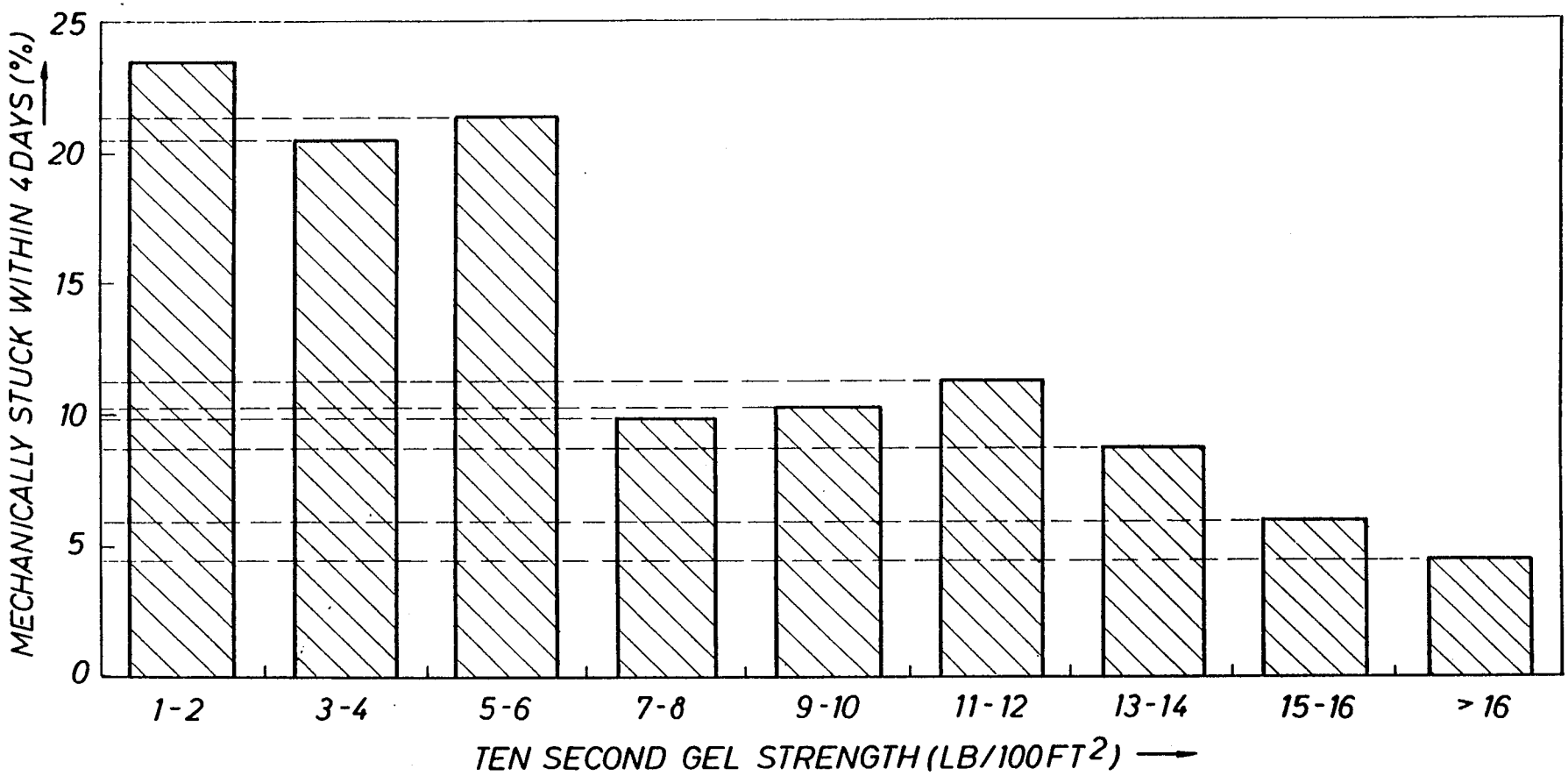
FIG. 2 shows a correlation between ten second gel strength and drill string sticking in wells less than 55 degrees to vertical.

Using engineering or drilling variables in the data base for about 400 wells, it was determined by well-known statistical analysis techniques that higher drilling fluid densities, higher annular velocities of drilling fluid (between the drill pipe and the bore hole wall) and higher drill pipe-to-bore hole wall distances were, on average, associated with lower incidents of mechanical sticking. For wells drilled at angles from 0 to 55 degrees, higher 10-second gel strengths were also associated with lower incidents of mechanical sticking. Example results of such statistical analysis are shown in FIG. 2, which illustrates the correlation between ten second gel strength and mechanical sticking which the drilling operator had classified as caused by sloughing or packing off for all wells drilled at angle 0° to 55°. As can be seen in this figure, wells drilled with fluids for which the ten-second gel strength had a value greater than 6 lb/100 ft.$^2$ became stuck at a much lower rate than wells with lower values of ten-second gel strength. It is clear from such an analysis that a parameter defined to predict sticking of drill pipe in low angle wells should contain the drilling variable ten second gel strength of the drilling fluid.

Further analysis of the data base for wells at angles less than 55° showed that hole-angles at intermediate values, but less than 55°, have an effect on sticking of the drill string. Data showed that sticking was more frequent at the higher angles. This added sticking tendency is presumably due to the formation of a sliding cuttings bed in the intermediate angle wells. A hole-angle function was derived to express this increased sticking tendency in intermediate angle wells. Statistically, a rather abrupt transition between near vertical and intermediate angle wells was found to occur at around 30°. This transition angle of 30° was chosen statistically using data from the 400 well data base. Specifically, a transition angle of 30° was selected based on maximizing the ability to discriminate between non-stuck wells and wells which became mechanically stuck, for all wells having angles less than or equal to 55°. The technique employed canonical discriminant analysis contained in the program CANDISC. This program is available from SAS Institute, Inc., of Cary, N.C. The commercially available program is widely used in industry. A user's guide to this program is available with the program which explains in detail the use of the program for canonical discriminant analysis. More specifically, the canonical discriminant analysis contained in the program CANDISC calculates a number of statistical indices. Among these indices is the so-called univariate F-value. The technique used in the preferred embodiment is to maximize this index.

An engineering parameter expressing hole-cleaning effectiveness, called "Effective Velocity" was defined which incorporated the variables found statistically to affect pipe sticking in hole angles up to 55°. The value of Effective Velocity was determined to be as follows:

$$EV = \frac{.00667 \times MW^{.7} \times AV \times f(TSG) \times GAP^{.6}}{f(\alpha)} + 15 \qquad \text{Eq. (1)}$$

where, $MW$ = Drilling fluid density, pounds per gallon $AV$ = Average annular velocity, feet per minute $$= \frac{19.25 \times GPM}{\pi/4 \times (\text{Bitsize}^2 - DPOD^2)}$$

$GAP$ = gap around drill pipe, inches $= \frac{1}{2}(\text{Bitesize} - DPOD)$ $$f(TSG) = \begin{cases} 5 \text{ if Ten Second Gel Strength } (TSG) \leqq 5 \text{ lb/100} \\ TSG \text{ if } 5 < TSG < 7.5 \\ 7.5 \text{ if } TSG \geqq 7.5 \end{cases}$$

$$f(\alpha) = \begin{cases} 1, \alpha = \text{hole angle} \leqq 30° \\ 1 + (\sin(\alpha - 30))^{.4}, \alpha > 30° \end{cases}$$

The numerical constant 15 is included in the definition of Effective Velocity in Equation (1) in order to have the range of EV the same for different hole angles and sizes, as will be explained further below.

The empirical exponents applied to the mudweight and drill pipe to borewall gap in Equation (1) were chosen in a manner similar to that explained above for the angle 30°. Different values of exponents were selected and Effective Velocity was calculated for wells in which the drill string stuck and wells in which it did not stick. The exponent values were varied until a statistical maximization occurred in the value of EV between those wells which stuck and did not stick. This discrimination was measured using canonical discriminant analysis, in particular by calculating the F-value, which is a well-known measure of statistical discrimination of classes.

For wellbore angles greater than 55°, it was found that the Effective Velocity parameter should be separately constructed for wellbores less than 10-inch diameter and those greater than 10-inch diameter. For larger wellbores, a separate set of engineering or drilling variables can be applied, as the mechanism of formation of a cuttings bed at the bottom of a hole allows the thickness of that cutting bed to be considered an engineering parameter. For smaller diameter holes, i.e., smaller than about 10-inch diameter, geometry of the bed is more complex. Therefore, the Effective Velocity parameter was separated into a definition for wellbore diameters greater than 10 inches and less than 10 inches.

The parameter Effective Velocity for wells smaller than 10-inch diameters was developed as a result of empirical analysis of data from over 1500 days of drilling in the Gulf of Mexico. The model developed was also found to be applicable to data in a data base from North Sea wells. Effective Velocity for this class of wells was found to be a strong function of annular velocity and the gap between the drill pipe and the bore hole wall. The product of these two quantities was found to be modified by a factor which will be defined below. This factor resulted from an engineering analysis of equilibrium forces acting upon a cutting in a highly inclined wellbore. The effective velocity for wellbore diameters less than 10-inches and angles greater than 55° was found to be:

$$EV = \frac{1.755 \times GPM \times S^{.2}}{\text{Bitsize} + DPOD} \quad \text{Eq. (2)}$$

where $GPM$ = Volume flowrate of the drilling fluid, gallons per minute $$S = \frac{1}{BF} - 1$$

$DPOD$ = Drill pipe $OD$, inches

Bitsize = Bit diameter, inches'

$$BF = \text{buoyancy factor} = 1 - \frac{MW}{8.33 \times 2.65}$$

The exponent applied to S in Equation (2) is purely empirical. This exponent was arrived at by varying the value of the exponent and calculating Effective Velocity for the wells in the data base, then maximizing the statistical discrimination between non-stuck wells and wells which became mechanically stuck. The same statistical technique as described above was used.

For hole-angles greater than 55° and bit sizes greater than 10-inch diameter, engineering models developed from statistics and laboratory experiments were utilized.

The parameter Effective Velocity for hole angles greater than 55° and diameters greater than 10 inches is as follows:

$$EV = .267 \times \left( \frac{19.25 \times GPM}{A_{CRIT}} - \frac{300}{S^{.2}} \right) + 87 \quad \text{Eq. (3)}$$

where $$A_{CRIT} = \frac{\pi}{4} \times ((1 - J) \times \text{Bitsize}^2 - DPOD^2)$$

The variable J in the expression for $A_{CRIT}$ is the "junk slot fraction" of the drill bit in use. This fraction reflects the percentage of the nominal bit area which is free for cuttings to pass through. This information is normally available from bit manufacturers. If not, it can be measured.

Figure 3:
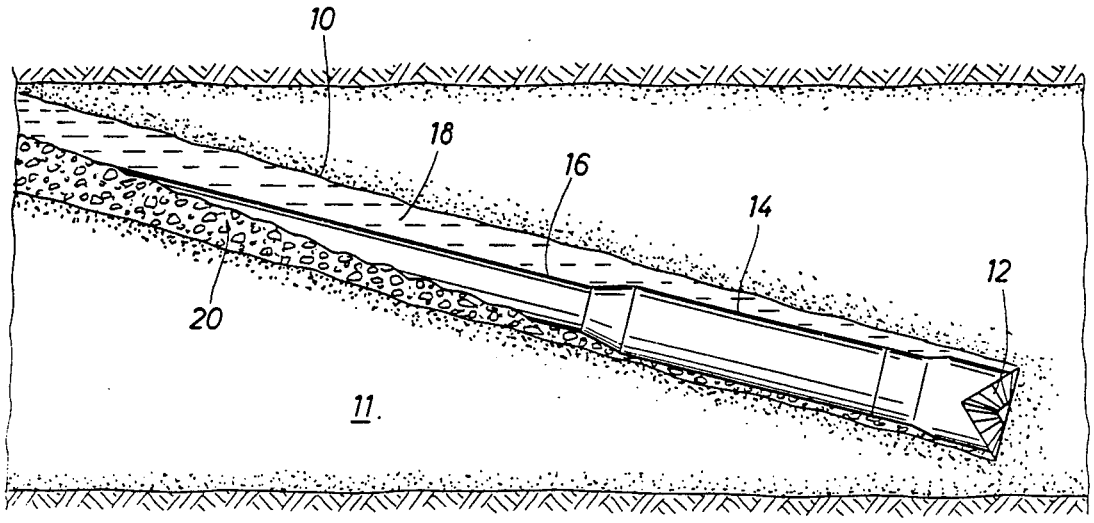
FIG. 3 shows a high angle wellbore being drilled by a bit on a drill string.

In the drilling of wells with diameters larger than about 10 inches, it is assumed that a significant cuttings bed will form during drilling. It is further assumed that during pulling the bit out of the hole, cuttings can flow around and through the retreating bit. As the bit is pulled out of the hole, through or over the cuttings bed, a moving crest of cuttings will form in the path of the retreating bit. FIG. 3 shows a high-angle wellbore 10 being drilled through subsurface formation 11. Bit 12 is at the bottom of drill string comprised of drill collars 14 and drill pipe 16. Drilling fluid 18 is circulated down the drill string, out bit 12 and up the annulus between the drill pipe and the wall of the bore hole 10. A bed of cuttings 20 has accumulated at the bottom of the wellbore. The diameter of the wellbore is equal to the bit diameter, called Bitsize.

Consider the case of a bit retreating through a cuttings bed whose cross-sectional area is greater than the free area through which cuttings can pass for the bed in question. For every unit in length the bit travels through this oversized bed, a certain volume of cuttings is constricted from flowing around the bit. This excess volume of cuttings will remain in the path of the bit. If the bit is removed over a sufficient distance without circulating the drilling fluid, the excess volume of constricted cuttings will grow into a wedge. This accumulated wedge is believed to be the cause of stuck pipe while pulling out of the hole when the stuck pipe is related to poor hole-cleaning in highly inclined wells of large diameter. Observations have been made repeatedly in laboratory tests which demonstrate this sticking mechanism. A similar mechanism operates while placing the bit and drill string into the hole.

Figure 4:
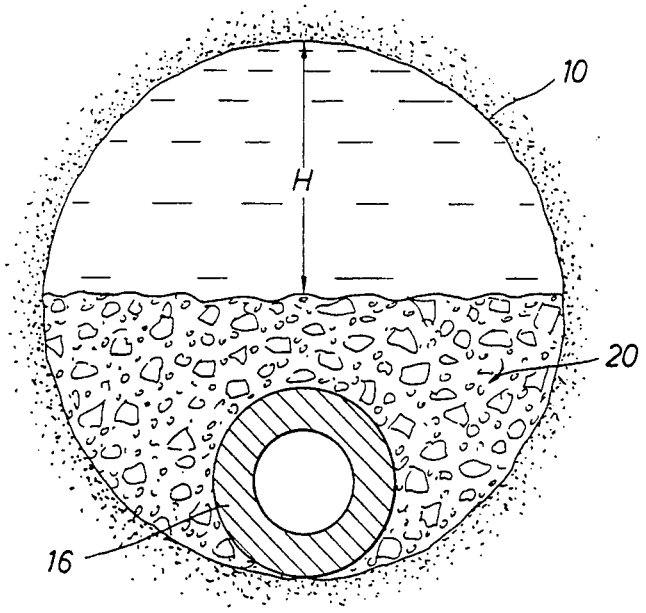
FIG. 4 shows a cross-section of a wellbore with a cuttings bed and drill pipe therein.

FIG. 4 shows a cross-section of a wellbore 10 having a cuttings bed 20 at the bottom and a drill pipe 16 therein. Consider that cuttings bed 20 with drill pipe 16 contained therein has cross-sectional area A. This amount of cuttings can pass a bit which is being pulled from the wellbore if the area between the bit and the wellbore is at least equal to A. Any greater bed height would cause an accumulation of cuttings ahead of the bit. The cuttings height having area A will be referred to as the threshold cuttings height, Bitsize-H.

The average fluid velocity above the threshold cuttings bed, $V^*$, is defined as $$V^* = \frac{19.25 \times GPM}{A_{CRIT}} \quad \text{(Feet per Minute)}$$

where $A_{CRIT}$ is defined as above. If this average velocity is greater than the average velocity needed to maintain the height of the cuttings bed ($V_{equil}$), then the cuttings bed will erode such that the area of cuttings bed 20 in FIG. 4 will be decreased. As this eroded cuttings height is less than the threshold height, sticking due to hole-cleaning problems is not expected upon pulling out of the hole. If, however, $V^*$ is less than the average velocity needed to maintain the height of a cuttings bed ($V_{equil}$), the cuttings bed will grow to have an area greater than that shown in FIG. 4. Sticking would be expected in this case.

The difference between $V^*$ and $V_{equil}$ was examined with respect to mechanical sticking incidents in the data base of about 400 wells. It was assumed that the equilibrium velocity above a cuttings bed is the following function of fluid density:

$$V_{equil} \text{ (ft per min)} = \frac{300}{S^{.2}} \quad \text{Eq. (4)}$$

where S is defined above. Using this value of $V_{equil}$ and the value of $V^*$ defined above, the difference between these two values was defined as $N = V^* - V_{equil}$.

N was calculated for the wells represented in the data base. N was found to discriminate strongly between wells where drill pipe sticking did not occur and wells which were to become mechanically stuck. This discriminating ability was determined using canonical discriminant analysis as described heretofore.

Again, numerical constants, in this case equal to 0.267 and 87, were included in the calculated value of Effective Velocity for this class of wells so that the value of EV varied from about 30 to about 80 for the wells in the data base. This allowed comparison of EV for this class of wells to EV for both the other well classes described above.

Figure 1:
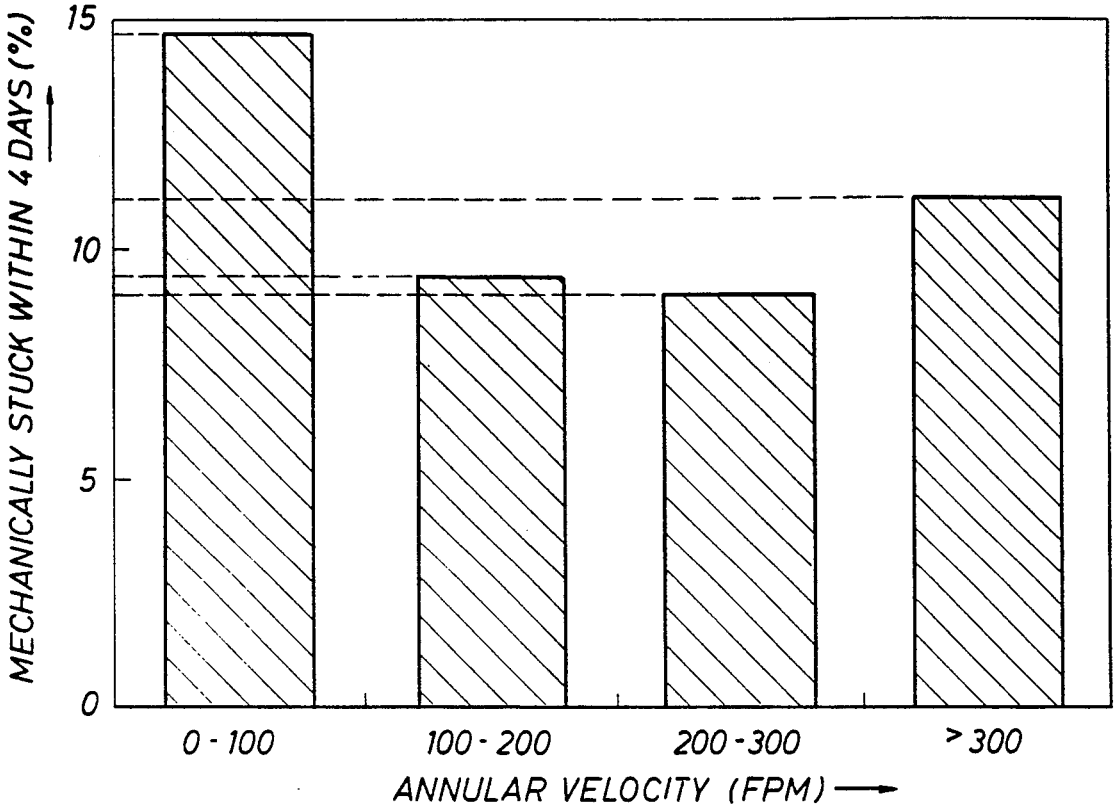
FIG. 1 shows a correlation between drill string sticking and annular velocity of the drilling fluid from a data base of about 400 wells.

Finally, a relation was developed between the frequency of sticking the drill string from mechanical causes related to inadequate hole-cleaning and the calculated values of Effective Velocity. To do this, all wells stuck by mechanisms not related to effective hole-cleaning, such as those stuck by excess hydrostatic pressure holding the drill string against the bore hole wall and those wells believed stuck due to salt flow and for unknown reasons were removed from the data base. Nearly 400 wells remained. Effective Velocity as defined in Equations 1, 2 and 3 was then calculated for each of these 400 remaining wells. Then, based on the sticking history of each well, the histogram shown in FIG. 5 was developed. The relationship shown in this figure shows a strong correlation between EV and the percentage of wells which became mechanically stuck within four days. This relationship shows that the historical risk of becoming stuck is quite high if the value of EV is less than 45. The risk of becoming mechanically stuck is many times less if the value of effective velocity is greater than 75. Such a relationship leads to the recommendation that EV never be allowed to be less than 45, and preferably, that it be maintained at or above 75. The improvement accruing from the utilization of Effective Velocity, as defined by the methods of this invention, over the use of average velocity in the annulus according to the prior art, as a predictor of frequency of stuck pipe can be appreciated by comparing FIG. 5 with FIG. 1.

As portions of Effective Velocity, as defined herein, are empirical in origin, the model can be no more reliable than the data used in its development. Further, it is only valid for situations which are significantly represented by previous wells in the data base. It is apparent that the methods outlined above for the development of the equations 1, 2 and 3 can be extended to data bases of particular relevance to wells of interest. For example, wells in the same geographic area or the same geologic province may be used to form the data base upon which the methods of this invention are applied. The combination of engineering models and statistical discriminant analysis, however, will be generally applicable to all data bases containing wells in which sticking of the drill string occurs as a result of inadequate hole-cleaning.

Figure 5:
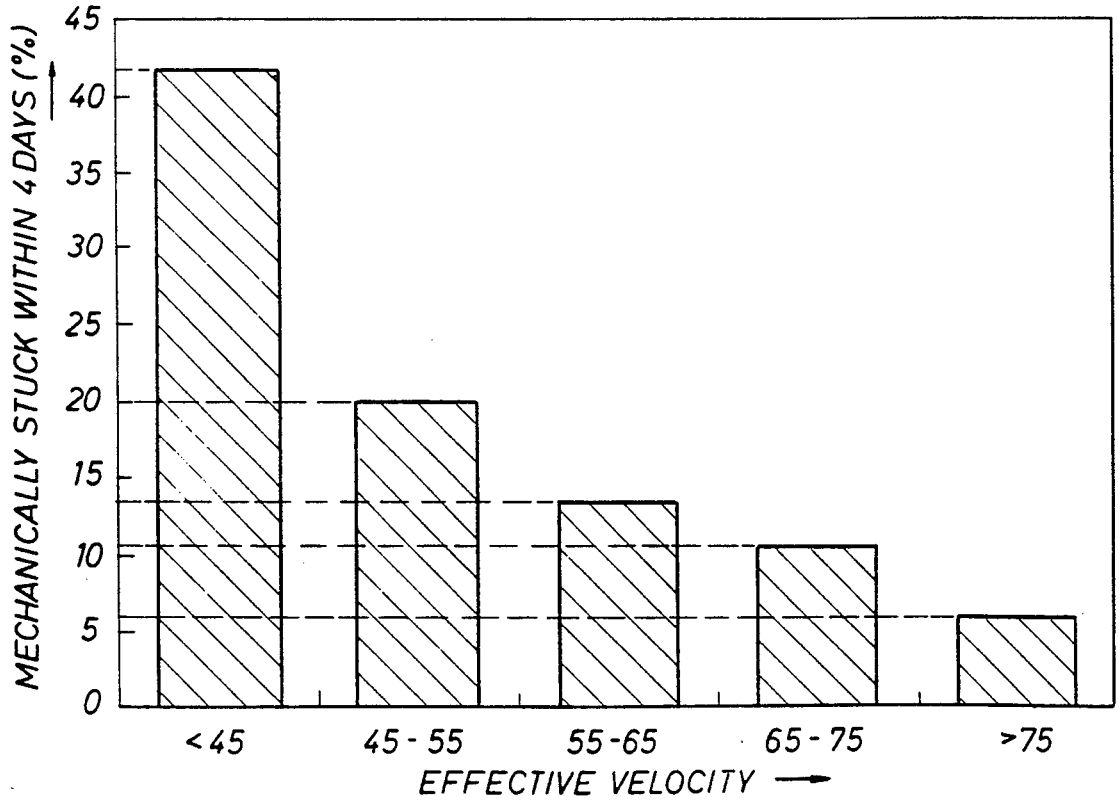
FIG. 5 is a graph showing the correlation of mechanically stuck drill string with the Effective Velocity of this invention.

The frequency of mechanical sticking as a function of effective velocity, as represented in FIG. 5, can be used along with an economic model to predict the minimum expected cost of drilling a well. Such analysis may be applied during the drilling process of a well or may be applied during the planning stages for the drilling of a well. For example, addition of pumping equipment during drilling of a well may increase effective velocity over an interval to be drilled from 50 to 80. Examination of FIG. 5 shows that the frequency of sticking will be decreased from 20% to about 6% with this increase in EV. Assume that if sticking occurs, the additional cost of the well is expected to be $500,000. The cost of supplying the additional pumping equipment is expected to be $25,000. The expected cost without the additional pumping equipment is thus $100,000 ($500,000 times 20%) and with the additional pumping equipment it is $55,000 ($500,000 times 6%, plus $25,000). Therefore, it is clear that addition of the pumping equipment is economically justified on the basis of the increase in Effective Velocity.

EXAMPLE 1

A 12¼" hole section is to be drilled at 45° of inclination. The drill pipe is 5" OD. The mud weight is 11 ppg and the 10-second gel of the drilling fluid is expected to be in the range of 2 to 4 pounds per 100 square feet. The preliminary drilling plan considers the use of a flow rate of 600 gpm. Are hole-cleaning problems to be expected?

Since the angle is below 55°, Equation (1) is used to calculate effective velocity. First, AV, f(TSG), f(α) and GAP are calculated. AV equal 117.6. f(TSG)=5. $f(\alpha)=1+(\sin(45-30))^{0.4}=1.58$. GAP=0.5×(12.25−5)=3.62. Then, using Equation (1), Effective Velocity equals 43.8. By inspection of FIG. 5, it can be seen that hole-cleaning problems are likely to occur. In the data base, more than 40% of wells experienced stuck pipe within four days at an Effective Velocity in the range less than 45. To minimize risk of hole-cleaning problems, effective velocity has to be increased, ideally to a value of 75 or higher. As can be seen from Equation (1), if it is assumed that mud weight, hole size and inclination, and drill pipe OD cannot be changed, then Effective Velocity must be increased by raising the flow rate (so as to raise AV), and/or by raising the 10-second gel. For example, if we use GPM =840 and TSG greater than or equal to 8, Equation (1) gives EV=75.

EXAMPLE 2

Consider an 8½-inch horizontal section. Suppose that the plan calls for a 5-inch drill pipe, a 14 ppg mud weight, and a 550 gpm flowrate. Are hole-cleaning problems to be expected?

Since the angle is above 55° and the bit size is less than 10 inches, Equation (2) is used. First, BF and S must be calculated.

$$BF = 1 - \frac{14}{8.33 \times 2.65} = 0.366$$

$$S = \frac{1}{.366} - 1 = 1.73$$

Then, using Equation (2), $$EV = \frac{1.755 \times 550 \times 1.73^{.2}}{8.5 + 5} = 79.8$$

Since EV>75, no hole-cleaning problems are expected.

EXAMPLE 3

Consider a 17½-inch hole section which is to be drilled at 80° of inclination with a roller-cone bit. Suppose that a 6⅝-inch drill pipe is used, and the mud weight is planned to be 13 ppg. What is the risk of incurring hole-cleaning problems with a flowrate of 1000 gpm?

Since the angle is above 55° and the bit size is greater than 10 inches, EV is calculated using Equation (3). First, we need to calculate $A_{CRIT}$, BF and S. The junk slot fraction of the bit J is determined to be 0.4. Then, $$A_{CRIT} = \frac{\pi}{4} \times ((1 - 0.4) \times 17.5^2 - 6.625^2) = 110$$

$$BF = 1 - \frac{13}{8.33 \times 2.65} = 0.411$$

$$S = \frac{1}{.411} - 1 = 1.43$$

Then, using Equation (3), $$EV = .267 \times \left(\frac{19.25 \times 1000}{110} - \frac{300}{1.43^{.2}}\right) + 87 = 59$$

As was the case in the first example, the risk of experiencing hole-cleaning problems can be reduced by increasing EV. Solving Equation (3) for GPM after setting EV=75, one finds that it would be desirable to raise the flow rate from 1000 gpm to 1340 gpm. If this is not feasible because of limitations in the circulating system, the flow rate should be kept as high as possible to minimize risk of sticking the drill string.

It will be appreciated that while the present invention has been primarily described with regard to the foregoing embodiments, it should be understood that variations and modifications may be made in the embodiments described herein without departing from the broad inventive concept disclosed above or claimed hereafter.

What we claim is:

1. A method for determining the probability of a drill string becoming stuck as a result of inadequate hole-cleaning in the process of drilling of a well comprising:

(a) from a database containing physical measurements of drilling variables obtained during the drilling of wells and occurrences of drill string sticking, selecting at least two drilling variables;

(b) combining the variables selected in step (a) to form at least one expression of hole-cleaning effectiveness, EV;

(c) calculating the value of the expression of hole-cleaning effectiveness, EV, obtained from step (b) in a plurality of wells and, using statistical analysis, measuring the statistical discrimination between those wells in which the drill string did or did not become stuck within a predetermined time of the measurements;

(d) repeating step (c) a number of times sufficient to select a combination of variables, coefficients and exponents producing a pre-selected measure of statistical discrimination between the expression for hole-cleaning effectiveness, EV, in those wells in which the drill string did or did not become stuck within a predetermined time of the measurements; and (e) calculating the value of the expression for hole-cleaning effectiveness, EV, determined in step (d) for a plurality of wells in the data base to produce a relationship between statistical frequency or probability of sticking within a predetermined time and the value of the expression of hole-cleaning effectiveness, EV.

2. The method of claim 1 wherein in step (a) the drilling variables are selected by statistical analysis.

3. The method of claim 1 wherein in step (b) a plurality of expressions of hole-cleaning effectiveness are formed, each expression applying to different ranges of hole-angle and hole size.

4. The method of claim 3 wherein different expressions are formed for hole angles above and below approximately 55 degrees to vertical.

5. The method of claim 4 wherein the expression of hole-cleaning effectiveness for hole angles below approximately 55 degrees includes the drilling variables drilling fluid density and gel strength, drilling fluid flow rate and a function of hole angle.

6. The method of claim 5 wherein the function of hole angle is different above and below a hole-angle of about 30 degrees.

7. The method of claim 4 wherein expressions of hole-cleaning effectiveness for hole angles above approximately 55 degrees are separately formed for hole diameters above approximately 10-inches and for hole diameters below approximately 10-inches.

8. The method of claim 1 wherein in step (c) the statistical discrimination is measured by F-value.

9. The method of claim 1 wherein in step (a) the data base is restricted to wells drilled within a selected geographic area or geological province.

10. A method of decreasing the probability of a drill string becoming stuck as a result of inadequate hole-cleaning in a well of interest comprising:

(a) from a database containing physical measurements of drilling variables obtained during the drilling of wells and occurrences of drill string sticking, selecting at least two drilling variables;

(b) combining the variables selected in step (a) to form at least one expression of hole-cleaning effectiveness, EV;

(c) calculating the value of the expression of hole-cleaning effectiveness, EV, obtained from step (b) in a plurality of wells and, using statistical analysis, measuring the statistical discrimination between those wells in which the drill string did or did not become stuck within a predetermined time of the measurements;

(d) repeating step (c) a number of times sufficient to select a combination of variables, coefficients and exponents producing a pre-selected measure of statistical discrimination between the expression for hole-cleaning effectiveness, EV, in those wells in which the drill string did or did not become stuck within a predetermined time of the measurements;

(e) calculating the value of the expression for hole-cleaning effectiveness, EV, determined in step (d) for a plurality of wells in the data base to produce a relationship between statistical frequency or probability of sticking within a predetermined time and the value of the expression o hole-cleaning effectiveness, EV; and (f) calculating the value of the expression for hole-cleaning effectiveness, EV, for a combination of variables existing in the well of interest and comparing such value of EV to values of EV determined in step (e); and (g) adjusting the value of a drilling variable so as to modify the value of EV in the well of interest.

11. The method of claim 10 wherein in step (a) the drilling variables are selected by statistical analysis.

12. The method of claim 10 wherein in step (b) a plurality of expressions of hole-cleaning effectiveness are formed, each expression applying to different ranges of hole-angle and hole size.

13. The method of claim 12 wherein different expressions are formed for hole angles above and below approximately 55 degrees to vertical.

14. The method of claim 13 wherein the expression of hole-cleaning effectiveness for hole angles below approximately 55 degrees includes the drilling variables drilling fluid density and gel strength, drilling fluid flow rate and a function of hole angle.

15. The method of claim 14 wherein the function of hole angle is different above and below a hole-angle of about 30 degrees.

16. The method of claim 13 wherein expressions of hole-cleaning effectiveness for hole angles above approximately 55 degrees are separately formed for hole diameters above approximately 10-inches and for hole diameters below approximately 10-inches.

17. The method of claim 10 wherein in step (c) the statistical discrimination is measured by F-value.

18. The method of claim 10 wherein in step (a) the data base is restricted to wells drilled within a selected geographic area or geological province.

19. A method of decreasing the expected cost of drilling a well comprising:

(a) from a database containing physical measurements of drilling variables obtained during the drilling of wells and occurrences of drill string sticking, selecting at least two drilling variables;

(b) combining the variables selected in step (a) to form at least one expression of hole-cleaning effectiveness, EV;

(c) calculating the value of the expression of hole-cleaning effectiveness, EV, obtained from step (b) in a plurality of wells and, using statistical analysis, measuring the statistical discrimination between those wells in which the drill string did or did not become stuck within a predetermined time of the measurements;

(d) repeating step (c) a number of times sufficient to select a combination of variables, coefficients and exponents producing a pre-selected measure of statistical discrimination between the expression for hole-cleaning effectiveness, EV, in those wells in which the drill string did or did not become stuck within a predetermined time of the measurements;

(e) calculating the value of the expression for hole-cleaning effectiveness, EV, determined in step (d) for a plurality of wells in the data base to produce a relationship between statistical frequency or probability of sticking within a predetermined time and the value of the expression of hole-cleaning effectiveness, EV;

(f) calculating the value of the expression for hole-cleaning effectiveness, EV, for a combination of variables existing in the well of interest and comparing such value of EV to values of EV determined in step (e);

(g) adjusting the value of a drilling variable so as to modify the value of EV in the well of interest;

(h) using the cost of adjusting the drilling variable and the effect of the adjustment on the relationship of step (e), calculating the effect of step (g) on the cost of the well; and (i) repeating steps (g) and (h) to minimize the expected cost of the well.

* * * * *